US008678659B2

(12) United States Patent
Miller et al.

(10) Patent No.: US 8,678,659 B2
(45) Date of Patent: Mar. 25, 2014

(54) METHOD FOR STABILIZING GUITAR VIBRATO TUNING

(71) Applicants: Harold John Miller, Fort Meyers, FL (US); Kyle Robert Miller, Fort Meyers, FL (US)

(72) Inventors: Harold John Miller, Fort Meyers, FL (US); Kyle Robert Miller, Fort Meyers, FL (US)

( * ) Notice: Subject to any disclaimer, the term of this patent is extended or adjusted under 35 U.S.C. 154(b) by 59 days.

(21) Appl. No.: 13/622,781

(22) Filed: Sep. 19, 2012

(65) Prior Publication Data

US 2013/0255468 A1 Oct. 3, 2013

Related U.S. Application Data

(60) Provisional application No. 61/626,022, filed on Sep. 19, 2011.

(51) Int. Cl.
*G10D 3/14* (2006.01)

(52) U.S. Cl.
CPC ..... *G10D 3/146* (2013.01)
USPC ..... 384/313

(58) Field of Classification Search
CPC ..... G10D 3/146
USPC ..... 84/313
See application file for complete search history.

(56) References Cited

U.S. PATENT DOCUMENTS

| | | | | | |
|---|---|---|---|---|---|
| D170,109 | S | * | 8/1953 | Bigsby | D17/21 |
| 2,781,685 | A | * | 2/1957 | White et al. | 84/312 R |
| 3,124,991 | A | * | 3/1964 | Costen | 84/267 |
| 3,162,083 | A | * | 12/1964 | Webster | 84/313 |
| 3,181,409 | A | * | 5/1965 | Burns et al. | 84/313 |
| 3,241,418 | A | * | 3/1966 | Fender | 84/313 |
| 3,250,167 | A | | 5/1966 | Porter | |
| 3,252,368 | A | * | 5/1966 | Jeffery et al. | 84/313 |
| 3,422,509 | A | * | 1/1969 | Porter | 84/313 |
| 3,424,049 | A | * | 1/1969 | Daniel | 84/313 |
| 3,457,821 | A | * | 7/1969 | Huis et al. | 84/313 |
| 4,100,832 | A | * | 7/1978 | Peterson | 84/313 |
| 4,141,271 | A | | 2/1979 | Mullen | |
| 4,171,661 | A | | 10/1979 | Rose | |
| 4,354,471 | A | | 10/1982 | Glaser, II | |
| 4,383,466 | A | | 5/1983 | Shibuya | |
| 4,457,201 | A | | 7/1984 | Storey | |
| 4,497,236 | A | | 2/1985 | Rose | |
| D278,067 | S | | 3/1985 | Bowen | |
| 4,512,232 | A | * | 4/1985 | Schaller | 84/313 |
| 4,648,304 | A | * | 3/1987 | Hoshino et al. | 84/313 |
| 4,782,732 | A | | 11/1988 | Kato et al. | |
| 4,852,448 | A | | 8/1989 | Hennessey | |
| 4,867,031 | A | * | 9/1989 | Fender | 84/313 |
| 4,939,971 | A | * | 7/1990 | Satoh | 84/313 |
| 5,672,835 | A | * | 9/1997 | Doughty | 84/313 |
| 5,783,763 | A | * | 7/1998 | Schaller et al. | 84/313 |
| 7,459,619 | B2 | * | 12/2008 | Gawenda | 84/313 |
| 7,709,713 | B1 | * | 5/2010 | Pearce et al. | 84/313 |
| 7,888,571 | B2 | | 2/2011 | Steinberger | |
| 8,071,868 | B2 | * | 12/2011 | Dennis | 84/313 |
| 2010/0011936 | A1 | * | 1/2010 | Dennis | 84/313 |
| 2010/0294110 | A1 | * | 11/2010 | Towner | 84/313 |
| 2013/0255468 | A1 | * | 10/2013 | Miller et al. | 84/313 |

* cited by examiner

*Primary Examiner* — Robert W Horn

(74) *Attorney, Agent, or Firm* — Harness, Dickey & Pierce, P.L.C.

(57) ABSTRACT

A guitar having a tremolo device with tonal stability is provided.

12 Claims, 2 Drawing Sheets

METHOD FOR STABILIZING GUITAR VIBRATO TUNING

CROSS-REFERENCE TO RELATED APPLICATIONS

This application claims the benefit of U.S. Provisional Application No. 61/626,022, filed on Sep. 19, 2011. The entire disclosure of the above application is incorporated herein by reference.

FIELD

The present disclosure relates to a stringed instrument and, more particularly, to a tremolo for stringed instruments.

BACKGROUND

This section provides background information related to the present disclosure which is not necessarily prior art.

The strings of a guitar are anchored near the lowermost end of the guitar body by a tailpiece. Occasionally, this tailpiece function is served by a vibrato, or tremolo, which is a piece of equipment designed to produce a unique sound effect similar to a singer's vibrato.

Vibrato mechanisms provide a means for changing the tension on all the strings of a guitar simultaneously. Changing the tension creates a pitch change in each vibrating string. This is accomplished by a moving tailpiece which pivots about an axis substantially perpendicular to the strings causing the length of the strings to vary. A handle is provided to facilitate a pulse-like pivoting of the tailpiece while simultaneously playing the instrument.

Traditional vibrato devices are installed on top of the guitar in an original equipment installation, or after removing an existing tailpiece in an after-market installation. The installation procedure is to string the strings over a pivoting metal bar, called the string bar, which is a component of the vibrato mechanism. Pins project from the string bar to connect with the strings by threading through a hole in the ball-end of each string.

The range of pitch change is limited both by the radius of rotation of a vibrato device and the degree of articulation with respect to its axis of rotation. Because a traditional vibrato mounts to the surface, and does not require the routing of a nesting location in the body of a guitar, its profile is relatively shallow. As a consequence, the range of a tremolo is essentially limited by the radius of the string bar. Traditional vibratos have the problem of tuning stability, especially in applications that don't use a specialized bridge. Some of the specialized bridges intended for use with these vibratos are problematic themselves for tuning instability. The current tremolo designs utilize low friction designs but do not provide any guidance of the string to maintain a properly aligned position. To date, this is accomplished somewhat unsuccessfully by the bridge.

The present teachings improves upon the widely-used vibrato design. It too addresses the aforementioned deficiencies, namely tonal instability, by providing a novel, universal and inexpensive vibrationally stable tremolo.

SUMMARY OF THE INVENTION

The invention presented is a significant improvement to the style of guitar vibratos (or tremolos). The vibrato utilizes a two roller system and a handle attached to the rear roller in order to stretch and loosen the guitar strings, thereby producing vibrato. The handle is spring loaded and the spring is compressed by string tension during the tuning process, thereby finding an equilibrium string tension and spring compression. During vibrato, the handle is moved up or down and the rear roller loosens or tightens the strings. The front roller provides a grooved surface that effectively lowers the string height (the string usually runs beneath the front roller). The lower string height is important for the purposes of proving "down pressure" on the bridge of the guitar. The bridge of the guitar suspends the effective length of the string (bridge to nut) and needs to have adequate pressure to "fret" the string.

It is accordingly an object of the present teachings to provide a vibrato device having vibrational or tonal stability. It is a further object to provide a roller having a string groove disposed in one of the string bars of the tremolo device and, therefore, increase stability by leveraging the string anchor points. The tuning stability is greatly enhanced by providing a low friction path from end to end of the string length. Tuning stability is also improved by preventing the string from "seating" in a non-aligned or improper position. The present teachings are a significant improvement designed to provide string alignment while maintaining the low friction properties.

As this is not intended to be an exhaustive recitation, other embodiments may be learned from practicing the invention or may otherwise become apparent to those skilled in the art. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
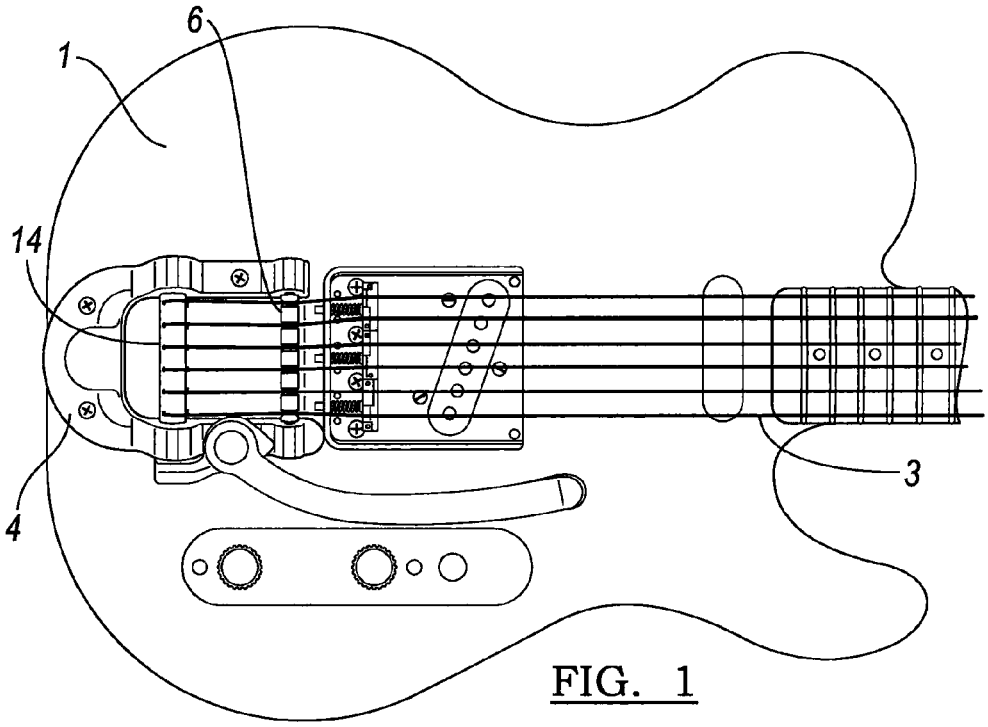
FIG. 1 represents a guitar utilizing the tremolo according to the present teachings.
Figure 2:
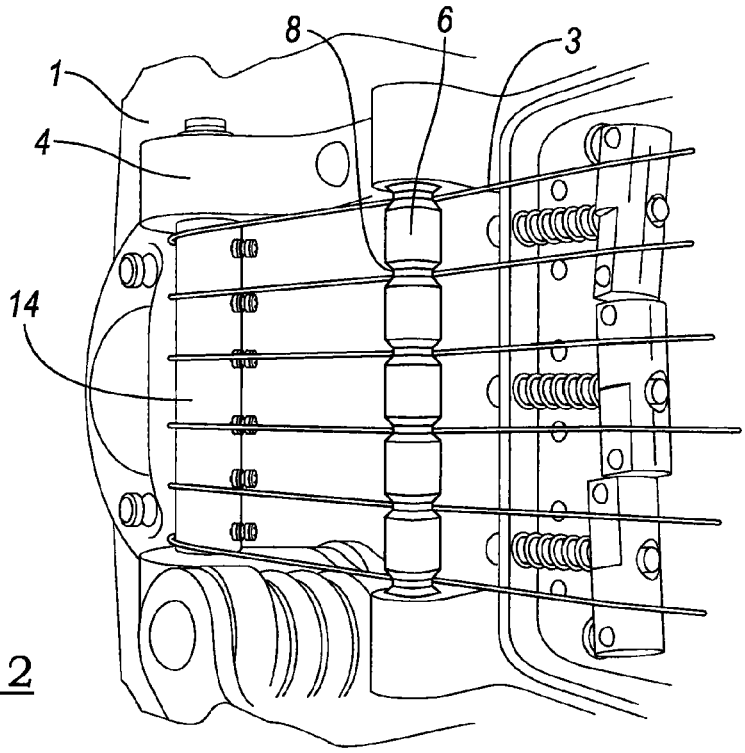
FIG. 2 represents a close-up of the tremolo shown in FIG. 1.
Figure 3:
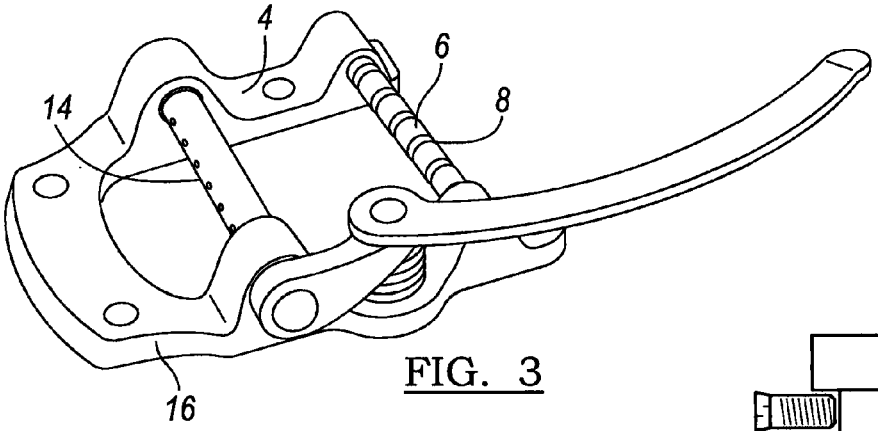
FIG. 3 represents a perspective view of the tremolo according to the present teachings.
Figure 4A:
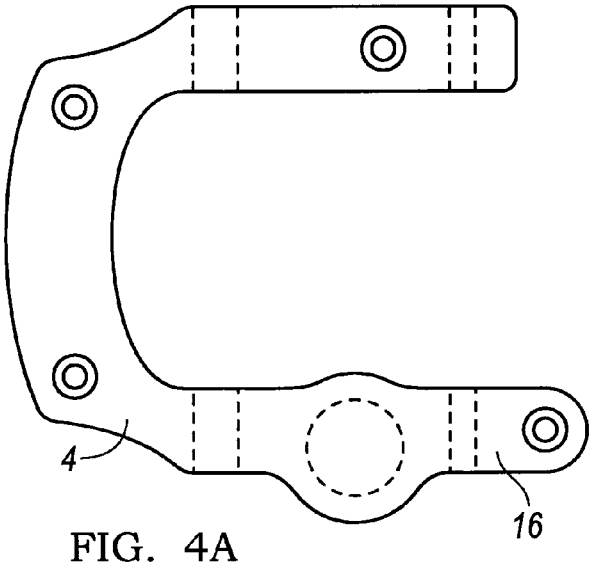
Figure 4B:
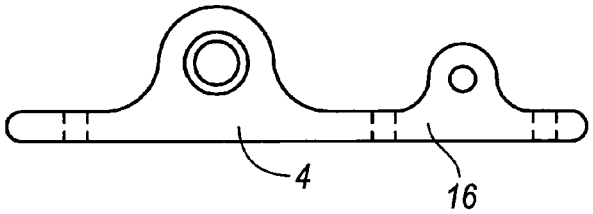
Figure 5:
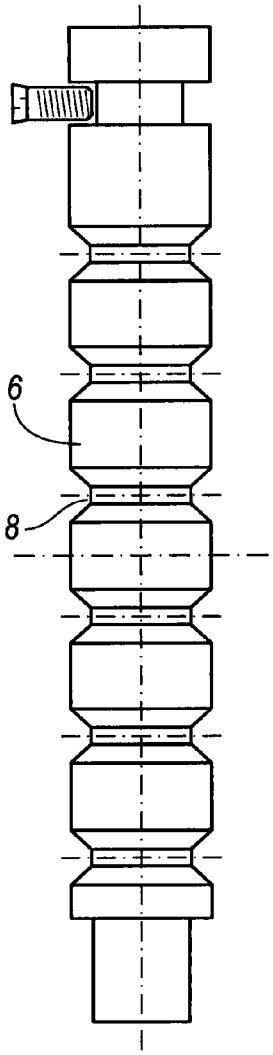

FIGS. 4*a* and 4*b* represent top and side views of a bracket for the tremolo shown in FIGS. 1-3; and FIG. 5 represents a roller used in the tremolo shown in FIGS. 1-3.

Corresponding reference numerals indicate corresponding parts throughout the several views of the drawings.

DETAILED DESCRIPTION

Example embodiments will now be described more fully with reference to the accompanying drawings.

As shown in FIGS. 1 and 2, the guitar 1 having the tremolo 4 according to the present teaching includes a front roller 6 or string bar that incorporates low friction grooves 8 in the roller 6. The roller 6 may be one piece or may be a complex unit with an axle and/or bearings. The grooves 8 are spaced so as to provide the proper string spacing for that portion of the guitar in relationship to the bridge or rear roller 14. It should be noted that this design allows for the string attachment pin 12 spacing to be different from the front roller 6 spacing which may also be different that the bridge spacing. The roller groove 8 spacing can be, for example, the same as the specified bridge spacing for a Fender Telecaster, but much different that the rear roller 14 pin spacing. As shown, the system uses a standard type Telecaster bridge and has no need for specialization, such as notching, to maintain excellent tenability. The front roller or string bar 6 assembly may be fixed in relation to a roller support bracket 16. Low friction surfaces could simply allow the string to glide over the surface. A stationary axle 6 could also include individual rolling elements or gliding surfaces such as Delrin or other appropriate materials.

FIGS. 1 and 2 show a guitar 1 having a string attachment bracket 16 defining vibrato device 4 with the vibrato device 4 mounted on a guitar 1. A plurality of strings 3 are terminated at the string attachment bracket or rear roller 14 after passing over a second groove roller 6. Because the strings 3 are caused to bend over the front or second roller 6, the second roller 6 effectively determines the vibrating length of the string. The string attachment roller 14 facilitates the re-stringing of the strings 3, which may follow from routine maintenance on the strings, or which otherwise may be necessitated by an after-market installation of a vibrato device.

FIG. 3 represents a perspective view of the tremolo 4 according to the present teachings. Shown is the string bar 14 that fixes one end of the guitar. The string 3 is then passed under the grooved string bar 6. As shown in FIGS. 4*a* and 4*b*, the tremolo 4 can have two pair of apertures which function to couple the bars to the bracket.

FIG. 5 represents a side view of the grooved bar 6 according to the present teachings. The grooves 8 can have a pair of flat surfaces that intersect at a flat bottom. Optionally, the grooves 8 can have surfaces that define a V-shaped groove. Optionally, the grooves 8 can have different cross-sectional areas. These groove sizes may be a function of the string size. Optionally, the grooves can have a circular concave bearing surface. As shown, the grooved string bar 6 can be annularly disposed about a bearing bar. This disposition can be fixed or rotatable.

Tensioning the strings on a guitar involves method and means well known in the musical arts. When tension is reapplied to the strings after engagement to the string attachment bracket, the force at the distal end is counter-balanced by the string pins at the proximal end acting about a fulcrum at the string bar. The string bar is biased against rotation in the direction of string tension by a vibrato spring. The balance of forces keeps the string pins, and the strings 3, in continuous contact with the grooved bar 6 throughout operational use, including rotation or translation of the first string bar during play of the vibrato, providing tension is maintained in the strings.

When the strings 3 are engaged in tension on the string attachment bracket mounted on the vibrato device, the string ends are caused to move, when the string bar is pivoted, in an arc defined by the radial distance from the axis of rotation. Because the radial distance is greater than in the case of a conventional mounting of the strings about the string bar, the greater arc subtended by a common angle will cause a wider fluctuation of tension and, thereby, of pitch. Consequently, the string attachment bracket 10, by repositioning the string ends away from the string pins, produces the beneficial effect of broadening the range of vibrato effect.

It is to be understood that the invention is not limited in its application to the details of construction and to the arrangements of the components set forth in the preceding description or illustrated in the drawings. For example, the slots may be replaced by pins, or some other feature of connection. Also, it is to be understood that the phraseology and terminology employed herein are for the purpose of the description and should not be regarded as limiting. The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A vibrato device mounted to a guitar with a plurality of strings:

a bracket mounted to the guitar;

a first string bar having a plurality of string pins mounted to the bracket; and a second string bar defining a plurality of string grooves mounted to the bracket.

2. The vibrato device according to claim 1, wherein the second string bar is rotatably coupled to the bracket.

3. The vibrato device according to claim 1, wherein the grooves have a pair of intersecting flat surfaces.

4. The vibrato device according to claim 1, wherein the grooves define a plurality of V-shaped channels about a periphery of the second string bar.

5. The vibrato device according to claim 1, wherein the second string bar has a sleeve annularly and rotatably disposed about a support bar.

6. The vibrato device according to claim 1, further comprising a pivot metal bar coupled to one of the first or the second string bars.

7. The vibrato device according to claim 1, wherein a string is fed below the second string bar and over the first string bar, said string being at least partially disposed within the groove.

8. The vibrato device according to claim 1, wherein the groove has a circular cross-section.

9. The vibrato device according to claim 1, wherein the plurality of grooves have varying depths.

10. The vibrato according to claim 1, wherein the grooves can have a plurality of different cross-sections.

11. The vibrato according to claim 10, wherein the cross-sections are a function of the string diameter.

12. The vibrato according to claim 1, further comprising a pivot bar coupled to the first string bar and configured to apply forces to the first string bar to displace the bar in a direction perpendicular to the guitar face.

* * * * *